US006951993B2

(12) United States Patent
Kikukawa et al.

(10) Patent No.: US 6,951,993 B2
(45) **Date of Patent: *Oct. 4, 2005**

(54) VACUUM SWITCH

(75) Inventors: Shuuichi Kikukawa, Hitachi (JP); Yasuaki Suzuki, Hitachi (JP); Tooru Tanimizu, Hitachi (JP); Koichi Murata, Kashiwa (JP); Ryotaro Hanabuchi, Chiba (JP)

(73) Assignees: Hitachi, Ltd., Tokyo (JP); The Tokyo Electric Power Company, Incorporated, Tokyo (JP)

( * ) Notice: Subject to any disclaimer, the term of this patent is extended or adjusted under 35 U.S.C. 154(b) by 32 days.

This patent is subject to a terminal disclaimer.

(21) Appl. No.: 10/863,249

(22) Filed: Jun. 9, 2004

(65) Prior Publication Data

US 2004/0222192 A1 Nov. 11, 2004

Related U.S. Application Data

(63) Continuation of application No. 10/365,516, filed on Feb. 13, 2003, now Pat. No. 6,855,903.

(30) Foreign Application Priority Data

Apr. 16, 2002 (JP) ..... 2002-113152

(51) Int. Cl.[7] ..... H01H 33/66

(52) U.S. Cl. ..... 218/118; 218/10; 218/139; 218/154

(58) Field of Search ..... 218/118, 134, 218/139, 119, 120, 140, 153–155, 2, 10, 14

(56) References Cited

U.S. PATENT DOCUMENTS

| | | | | |
|---|---|---|---|---|
| 4,445,162 A | * | 4/1984 | Hamm et al. | 361/622 |
| 6,144,005 A | | 11/2000 | Tanimizu et al. | |
| 6,335,502 B1 | | 1/2002 | Kikukawa et al. | |
| 6,498,314 B2 | | 12/2002 | Miyo et al. | |
| 6,753,493 B2 | * | 6/2004 | Rhein et al. | 218/120 |

FOREIGN PATENT DOCUMENTS

| | | |
|---|---|---|
| JP | 2000-268685 | 9/2000 |
| JP | 2000-268686 | 9/2000 |

* cited by examiner

*Primary Examiner*—Lincoln Donovan
*Assistant Examiner*—M. Fishman
(74) *Attorney, Agent, or Firm*—Mattingly, Stanger, Malur & Brundidge, P.C.

(57) ABSTRACT

A vacuum switch comprises a vacuum container, a grounding switch and a load switch disposed in the container, and an external connection conductor disposed in the vacuum container and to be connected electrically inside and outside the vacuum container, and it is characterized in that the grounding switch and the external connection conductor are electrically connected to each other in the vacuum container.

10 Claims, 4 Drawing Sheets

VACUUM SWITCH

This is a continuation application of U.S. Ser. No. 10/365,516, filed Feb. 13, 2003 now U.S. Pat. No. 6,855, 903.

BACKGROUND OF THE INVENTION

1. Technical Field of the Invention

The present invention relates to a noble vacuum switch containing therein a plurality of grounding switches in a switchgear.

2. Description of Prior Art

Vacuum switches each of which is provided with a plurality of grounding switches in a vacuum container are disclosed, for example, in JP A 2000-268685 and JP A 2000-268686. Those vacuum switches each accommodate the plurality of grounding switches in the vacuum container, however, each grounding switch is made a pair with other switch and independently arranged, and respective grounding switches are not connected inside the vacuum container.

SUMMARY OF THE INVENTION

In the case where respective grounding switches in the vacuum container are individual from each other, a grounding terminal portion connecting an external of the vacuum container and the grounding switch is necessary for each switch and it is necessary to secure a space for arranging each grounding terminal at the outside of the vacuum container. Further, in order for each grounding terminal to be insulated from peripheral parts, it is necessary to secure an insulation distance in addition to a space for accommodating the grounding terminal, so that the size of the whole vacuum switchgear becomes large.

An object of the present invention is to provide a compact vacuum switch which reduces an external space of the vacuum switch.

The present invention makes it possible to reduce an exterior space of a vacuum container and provide a compact vacuum switch by connecting, inside the vacuum container, respective switches in the vacuum container and providing a single grounding terminal connecting to an external of the vacuum container in a switchgear, particularly, in the vacuum switch containing therein a plurality of grounding switches.

Concretely, the present invention resided in a vacuum switch which comprises fixed electrodes of a plurality of circuit breaker portions or disconnector portions as load switches, movable electrodes which contact with separate from the fixed electrodes, fixed electrodes of a plurality of grounding device portions, movable electrodes which contact with and separate from the fixed electrodes thereof, each contained in a vacuum container, insulating bushings led out from the vacuum container, load conductors led out from the insulating bushings, a vacuum degree measuring device grounded on the vacuum container, and operation rods driving the movable blades of the circuit breaker portions or disconnector portions and the grounding device portions.

That is, the present invention resides in a vacuum container which comprises a plurality of circuit breaker portions or/and disconnector portions, and grounding switches, and in which, particularly, a plurality of the grounding switches are electrically connected to each other in the vacuum container.

Concretely, the present invention resides in a vacuum switch which comprises a vacuum container, a grounding switch and a load switch each disposed in the vacuum container, and an external connection conductor disposed in the vacuum container and to be connected electrically inside and outside the vacuum container, and which is characterized in that the grounding switch and the external connection conductor are electrically connected to each other inside the vacuum container.

Further, the present invention resides in a vacuum switch comprising a vacuum container, a plurality of grounding switches and a load switch each disposed in the vacuum container, and an external connection conductor disposed in the vacuum container and connected electrically inside and outside the vacuum container, and characterized in that the plurality of grounding switches are electrically connected to each other in the vacuum container and the grounding switches and the external connection conductor are electrically connected to each other in the vacuum container.

Further, the present invention resides in a vacuum switch comprising a vacuum container, a grounding switch and a load switch each disposed in the vacuum container, and an external connection conductor disposed in the vacuum container and to be connected electrically inside and outside the vacuum container, and characterized in that a movable side electrode of the grounding switch is electrically connected, inside the vacuum container, to a movable rod insulated from the vacuum container and to be connected to an external, and the grounding switch and the external connection conductor are electrically connected to each other in the vacuum container.

Further, the present invention resides in a vacuum switch comprising a vacuum container, a grounding switch and a load switch each disposed in the vacuum container, and an external connection conductor disposed in the vacuum container and to be connected electrically inside and outside the vacuum container, and characterized in that a fixed side electrode of the grounding switch and a fixed side electrode of at least one of the circuit breaker portion and disconnector portion are connected by a conductor inside the vacuum container to be an integrate, and the grounding switch and the external connection conductor are electrically connected to each other in the vacuum container.

In the present invention, the vacuum circuit breaker portion is composed of necessary components for effecting vacuum circuit breaking, such as a movable electrode, fixed electrode, conductors supporting them and a vacuum container containing therein them. Further, the disconnector portion is a device connected to the circuit breaker portion and holding the circuit breaker portion in a condition of being disconnected when necessary, and including a vacuum container accommodating therein components thereof.

In the present invention, since a plurality of grounding switches become necessary in the vacuum container accommodating a plurality of circuits, it is desired to extremely reduce a space for an external connection portion and to minimize a space for the whole vacuum switchgear.

Therefore, in the present invention, such a construction that the respective grounding switches accommodated in the vacuum container are connected inside the vacuum container is taken. As a result, it is possible to construct a single connection terminal through which the connection to the external of the vacuum container is effected and make the vacuum switchgear compact.

Further, in the present invention, the respective grounding switches are connected by a flexible conductor, so that the respective grounding switches can be operated independently from each other to be at make and at break. Further, since the flexible conductor is arranged in the vacuum container, in order to be operated in the vacuum, the flexible conductor is constructed in such a structure that current passage portion is composed of laminated thin plates (0.1 mm–0.2 mm) of non-copper and stainless steel plates each inserted therebetween, being thinner than the non-copper plate and having an oxidized layer, whereby the non-copper plates are not adhered each other and the flexibility can be kept.

It is preferable to form the above-mentioned flexible conductor to be a convex shape in an opposite direction to the current passage portion so that a sufficient distance between the flexible conductor and the main circuit current passage portion can be taken.

Further, in the present invention, such a structure is desirable that plating, preferably silver plating is provided at connection portions between the flexible conductor and respective grounding switches, the plating at the connection portions is melted at a vacuum brazing temperature when the vacuum container is being manufactured, and the flexible conductor and the respective grounding switches are joined. Thereby, it is possible to effect the joining of the flexible conductor at the same time as the vacuum container is brazed in vacuum and assembled, whereby the vacuum container can be assembled without increasing working steps.

EXPLANATION OF SYMBOLS

1 . . . grounded vacuum container, 2, 3 . . . connection conductor, 4, 5, 19, 20, 21, 26 . . . insulator, 16, 17, 18 . . . movable conductor, 22, 23, 24 . . . bellows, 25 . . . vacuum pressure measuring device, 27, 33 . . . external connection conductor, 28, 29, 30 . . . movable rod, 31, 32 . . . flexible conductor, 34, 35 . . . link conductor.

DESCRIPTION OF EMBODIMENTS OF THE INVENTION

Embodiment 1

Figure 1A:
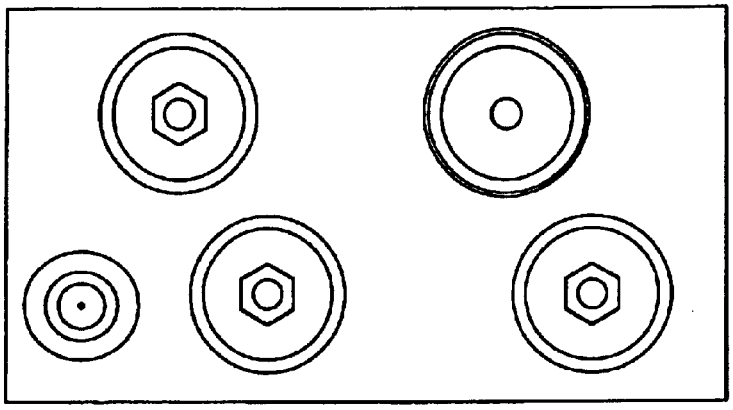
FIG. 1*a* is a plane view of a vacuum switch of an embodiment of the present invention.
Figure 1B:
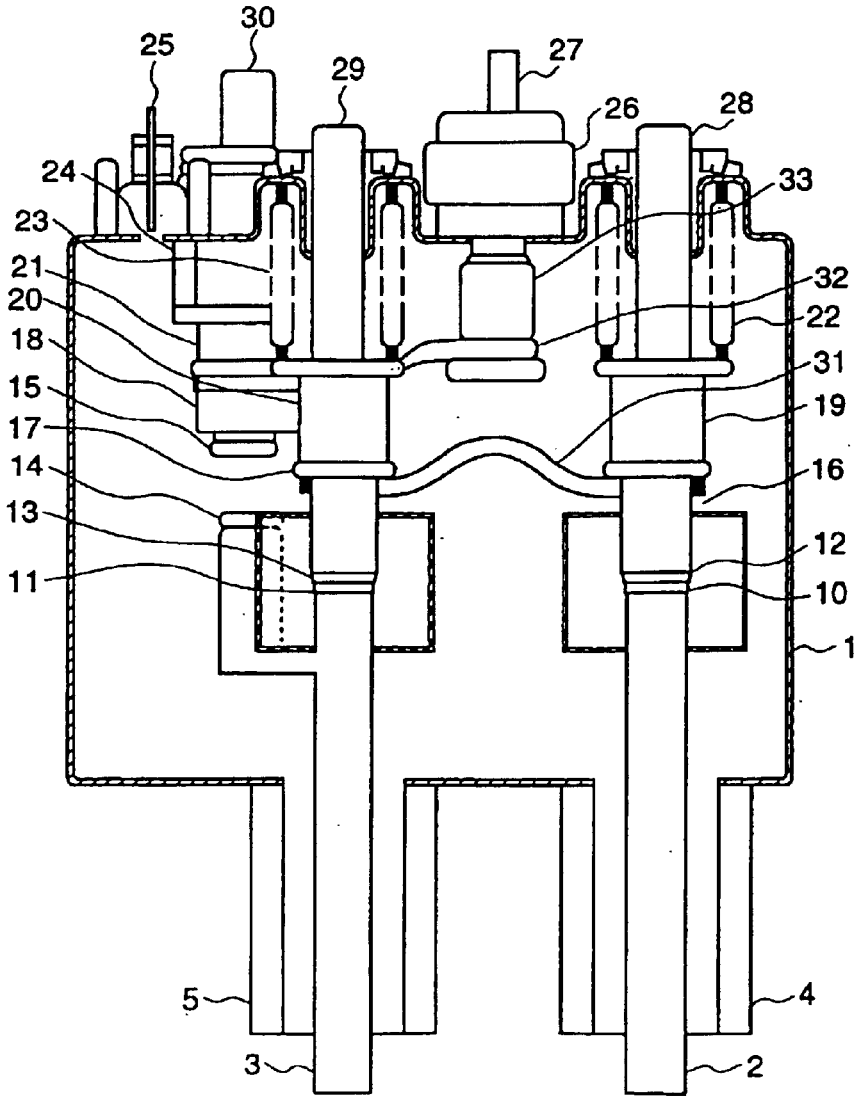
FIG. 1*b* is a sectional view showing a construction of the vacuum switch of FIG. 1*a;*

FIG. 1*a* is an upper plane view of a vacuum switch of an embodiment of the present invention, and FIG. 1*b* is a sectional view of the vacuum switch of FIG. 1*a*.

In a grounded vacuum container 1, movable electrodes 12, 13 and fixed electrodes of two circuit breaker portions or disconnector portions, and a movable electrode 15 and a fixed electrode of one grounding device portion are contained, and a vacuum pressure measuring terminal 25 of a vacuum pressure measuring device mounted on the grounded vacuum container 1 is provided. As shown in FIG. 1*a*, the two circuit breaker portions or disconnector portions are arranged in a row, the one grounding device portion and external connection portion 27 are arranged in a row and the row are in parallel with each other.

An external connection conductor 27 is insulated from and connected to the grounded vacuum container 1 by upper and lower non-magnetic stainless steel caps sandwiching a cylindrical insulator made of ceramics such as alumina, zirconia, or the like and disposed at a central portion in the outside of the grounded vacuum container 1.

Most of the grounded vacuum container 1 is made of conductive material such as metal of high strength, non-magnetic stainless steel, etc., and the grounded vacuum container 1 is grounded. The vacuum pressure of the grounded vacuum container 1 is monitored by the vacuum measuring device 25. Insulation between the grounded vacuum container 1 and vacuum container internal conductors are kept by insulators 4, 5, 19, 20, 21, 26 made of the above-mentioned ceramics.

The fixed electrode 10 and movable electrode 12, the fixed electrode 11 and movable electrode 13, and the fixed electrode 14 and movable electrode 15, which are contactable and separable from each other, are arranged inside the grounded vacuum container 1, and respective movable electrodes are made to contact with and separate from respective fixed electrodes by a command of an operation mechanism to make and brake. The movable electrodes 12, 13 and 15 are connected to movable conductors 16, 17 and 18, respectively, and the movable conductors 16, 17 and 18 are connected to movable rods 28, 29 and 30 through insulators 19, 20 and 21, respectively and connected to operation mechanism portions. The movable rods 28, 29 and 30 are air-tightly sealed by bellows 22, 23 and 24, respectively. Shield covers made of non-magnetic stainless steel are provided around a connection portion of the fixed electrode 10 and movable electrode 12 and a connection portion of the fixed electrode 11 and movable electrode 13.

The fixed electrode 10 is connected to a connection conductor 2 and connected to an external of the grounded vacuum container 1 therethrough. In the same manner, the fixed electrode 11 is connected to a connection conductor 3 and connected to an external of the grounded vacuum container 1. The connection conductors 2, 3 are covered with insulators 4, 5, respectively, outside the grounded vacuum container 1.

The connection conductor 2 and connection conductor 3, each of which is connected to the external, are electrically connected when the movable electrodes 13 and 12 are in the condition of being in contact with the fixed electrodes since the movable conductor 16 and the movable conductor 17 are connected through a flexible conductor 31. Further, the grounding portion fixed conductor 14 is connected to a grounding terminal portion conductor 33 through a flexible conductor 32, so that the grounding portion fixed conductor is electrically connected to the external connection conductor 27 when the grounding portion movable electrode 15 is in contact with the fixed electrode.

The external connection conductor 27 is connected to the grounding terminal portion conductor 33 connected to the connection portion of the flexible conductor 32 thereby to be formed in an integrate, and the external connection conductor 27 is insulated from the grounded vacuum container 1 by the insulator 26.

Since the flexible conductors 31, 32 are arranged in the vacuum container, in order to secure an operation in vacuum, a current passage portion of each of the flexible conductors is formed of laminated thin plates (0.1 mm–0.2 mm) of non-oxygen copper and stainless steel plates inserted between the thin plates, each stainless plate having an oxidized layer and being thinner than the non-oxygen copper thin plate, whereby the current passage portion is made in a structure in which non-oxygen copper plates are not adhered each other in vacuum and its flexibility can be kept.

Further, the flexible conductor is formed in a convex-shape to an opposite direction to the current passage portion so that a sufficient distance between the flexible conductor and a main circuit current passage portion can be taken.

Further, in the present embodiment, silver plating is provided for a connecting portion between the flexible conductor 32 and the movable conductor 18 of a grounding switch, the connecting portion is connected by melting a blazing material of silver at a vacuum brazing temperature when the vacuum container is manufactured. Thereby, it is possible to join the flexible conductor at the same time as the vacuum container is assembled by vacuum brazing, and it is possible to assemble the vacuum container without increasing working steps.

As mentioned above, in the vacuum switch containing therein the grounding switches of the present embodiment, it is possible to reduce an exterior space of the vacuum container and make the vacuum switch compact by connecting, inside the vacuum container, the respective grounding switches disposed inside the vacuum container and by performing connection to the external of the vacuum container by a single grounding terminal.

Embodiment 2

Figure 2A:
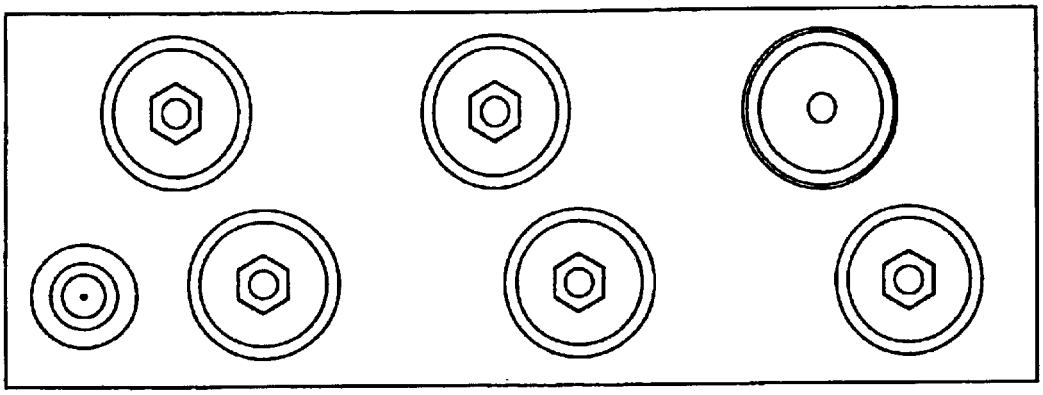
FIG. 2*a* is a plane view of a vacuum switch of another embodiment of the present invention.
Figure 2B:
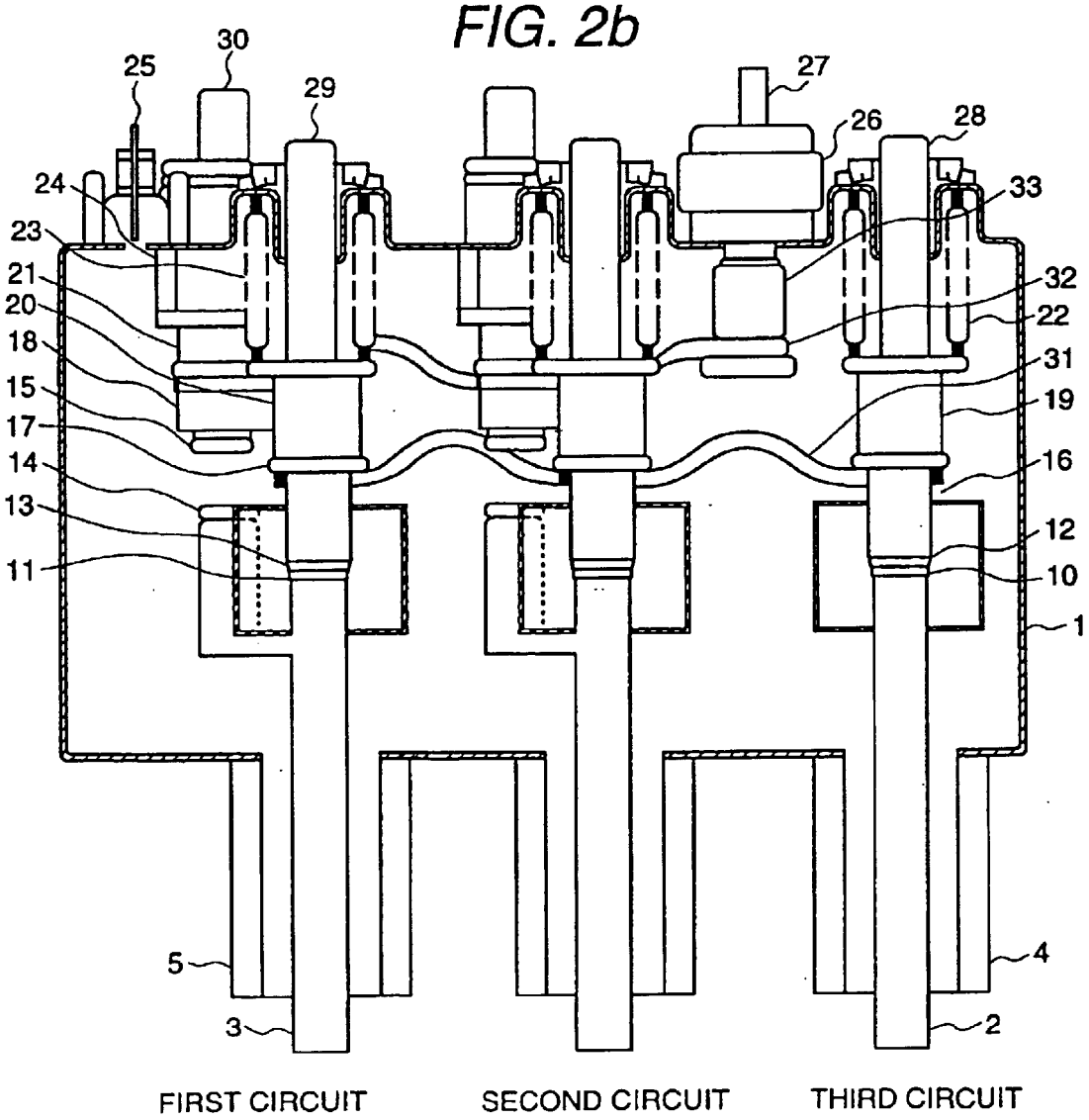
FIG. 2*b* is a sectional view showing a construction of the vacuum switch of FIG. 2*a;*

FIG. 2*a* is an upper plane view of a vacuum switch of another embodiment 2 of the present invention, and FIG. 2*b* is a sectional view of the vacuum switch of FIG. 2*a*.

The present embodiment contains a pair of switch of the circuit breaker portion or disconnector portion and a grounding switch in addition to the embodiment 1 of FIGS. 1*a* and 1*b*, and connects between respective circuits by the respective flexible conductors 31, 32. Therefore, a basic construction of the present embodiment is the same as the embodiment 1 and the manufacturing method also is similar thereto.

It is possible to electrically connect between any circuits by effecting making and braking operations of each movable electrode of each circuit. In grounding portion switches, since movable conductors of a first circuit and a second circuit are connected to the grounding portions through a flexible conductor, when the grounding portion movable electrode of the first circuit is made at make and the grounding portion movable electrode of the second circuit is made at break, the first circuit is grounded through the grounding terminal portion, and it is possible to ground the second circuit by turning the grounding portion movable electrode of the first circuit at break and turning the grounding portion movable electrode of the second circuit at make. Further, it is possible to ground both the first and second circuits through the grounding terminal portion by turning the grounding portion movable electrode at make.

Further, even if the movable electrode of the grounding portion of the first circuit is made at make and the movable electrode of the grounding portion of the second circuit is made at break, when the movable electrode of the circuit breaker portion or disconnector portion is at make, the second circuit is grounded through the flexible conductor of the circuit breaker or disconnector portion, so that in the case of turning the grounding portion movable electrode of the second circuit to be at make, such an interlock that the movable electrode of the circuit breaker portion or disconnector portion of the first circuit is at break and can not be operated to be at make is provided. As for the second circuit, also, in the similar manner, in the case where the grounding portion movable electrode of the second circuit is at make, such an interlock that the movable electrode of the circuit breaker portion or disconnector portion of the second circuit is at break and can not be operated to be at make is provided.

As mentioned above, in the vacuum switch containing therein the grounding switches of the present embodiment, it is possible to reduce an exterior space of the vacuum container and make the vacuum switch compact by connecting, inside the vacuum container, the respective grounding switches disposed inside the vacuum container and by performing connection to the external of the vacuum container by the single grounding terminal.

Embodiment 3

Figure 3:
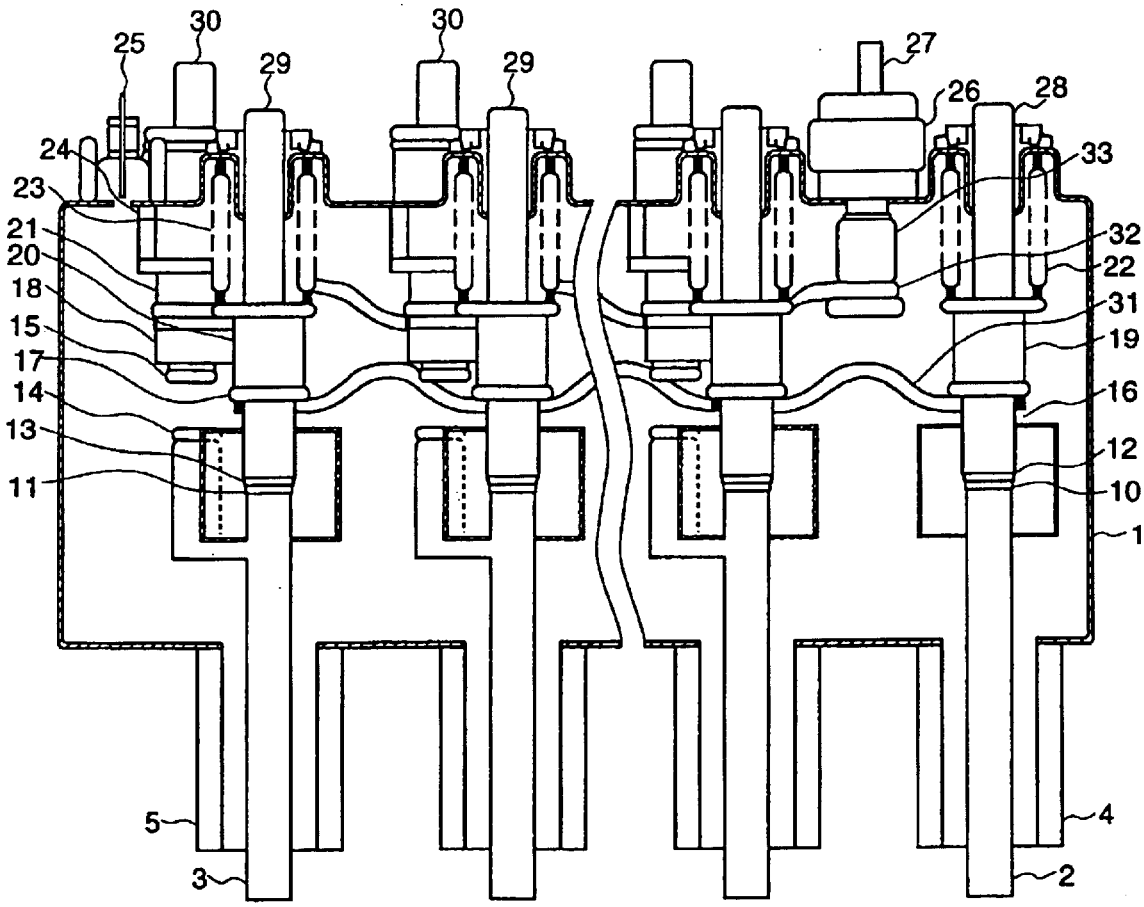
FIG. 3 is a sectional view showing a construction of a vacuum switch of further another embodiment of the present invention.

FIG. 3 is a sectional view of a vacuum switch of a further another embodiment 3 of the present invention.

The present embodiment contains a switch of a circuit breaker portion or disconnector portion and a grounding switch in addition to the embodiment 2 of FIGS. 2*a* and 2*b*, and connects between respective circuits by the respective flexible conductors 31, 32. Therefore, a basic construction of the present embodiment is the same as the embodiment 1 and the manufacturing method also is similar thereto.

As for the vacuum container containing therein three or more circuits in the present embodiment, also, any circuit can be grounded from a single grounding terminal by connecting respective circuits by the flexible conductor and turning the electrode of each circuit at make through the flexible conductor.

As mentioned above, in the vacuum switch containing therein the grounding switches of the present embodiment, it is possible to reduce an exterior space of the vacuum container and make the vacuum switch compact by connecting, inside the vacuum container, the respective grounding switches disposed in the vacuum container and by performing connection to the external of the vacuum container by the single grounding terminal.

Figure 4A:
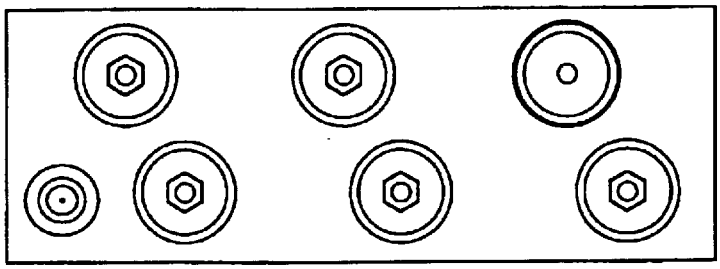
FIG. 4*a* is an upper plane view showing an example of a switch arrangement of the vacuum switch of FIG. 3.
Figure 4B:
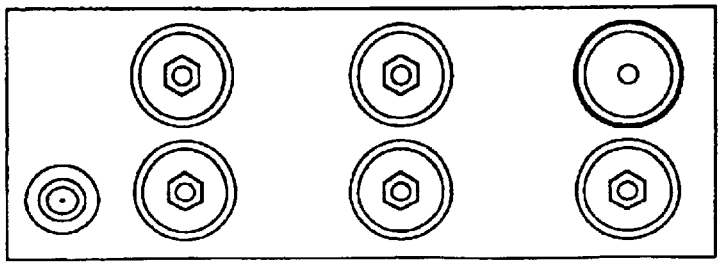
FIG. 4*b* is an upper plane view showing another example of a switch arrangement of the vacuum switch of FIG. 3.

FIGS. 4*a* and 4*b* each are an upper plane view of FIG. 3. In the arrangement of switches of respective circuits, an arrangement of respective switches of circuit breaker or disconnector portions and an arrangement of the grounding switch and the external connection conductor are in parallel with each other, but a zigzag arrangement as shown in FIG. 4*a* is preferable to secure a sufficient insulation distance. However, it is possible to take a lattice-like arrangement as shown in FIG. 4*b*.

As mentioned above, in the vacuum switch accommodating therein the grounding switches of the present invention, also, it is possible to reduce an outside space of the vacuum container and make a compact vacuum switch by connecting each grounding switch of the interior of the vacuum container inside the vacuum container and providing a single grounding terminal through which the external of the vacuum container is connected.

Embodiment 4

Figure 5:
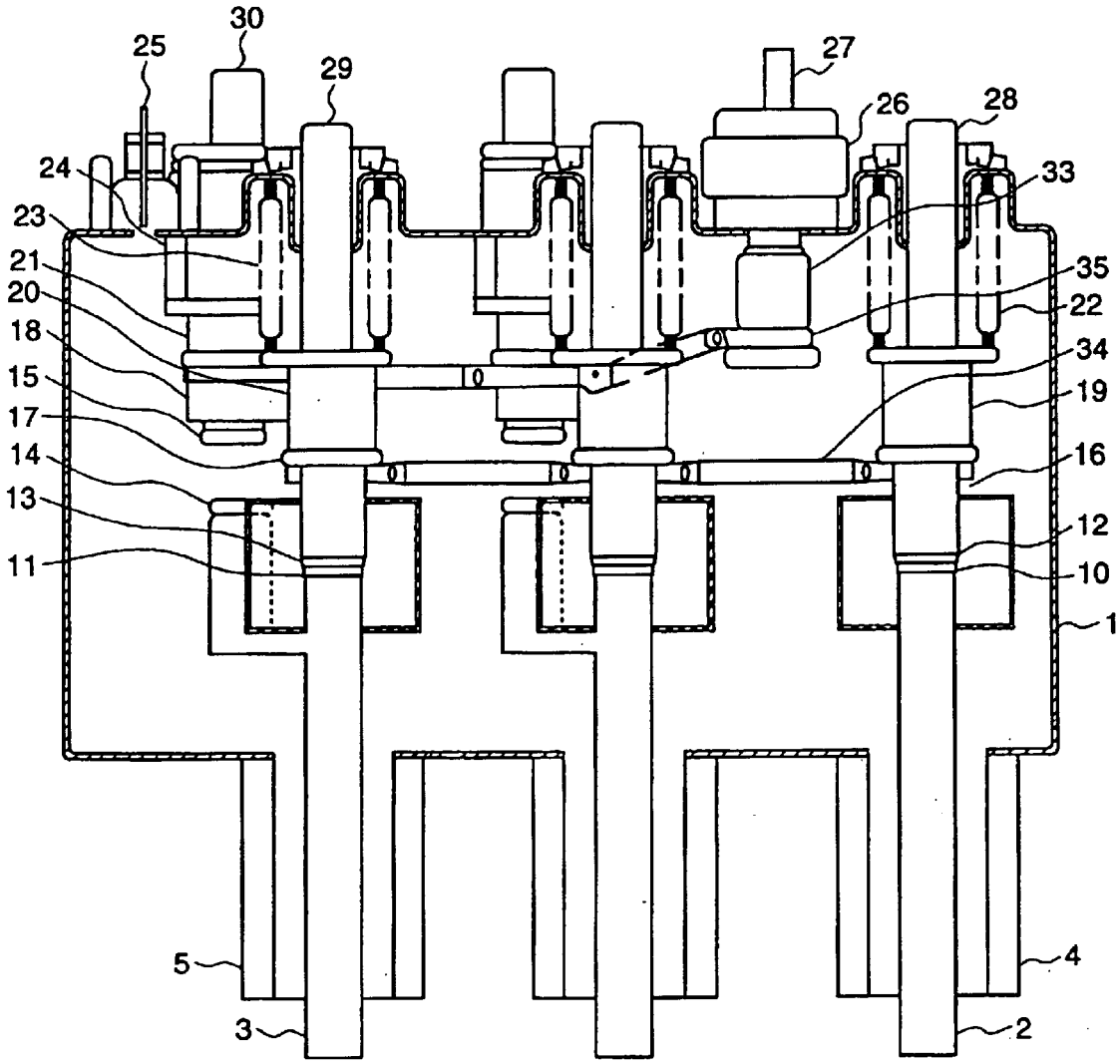
FIG. 5 is a sectional view showing a construction of a vacuum switch according to still further another embodiment of the present invention.

FIG. 5 is a sectional view of a vacuum switch of still further another embodiment 4 of the present invention.

In the present embodiment, conductors connecting respective circuits each are made in link structure instead of the above-mentioned flexible conductor. In the present embodiment, in addition to the embodiment 2 of FIGS. 2*a* and 2*b* further switches of circuit breaker portion or disconnector portion and a grounding switch are contained in the vacuum container and respective circuits are connected by respective link conductors 34, 35. Therefore, the basic construction of the present embodiment is the same as the embodiment 1.

As mentioned above, in the vacuum switch accommodating therein the grounding switches of the present invention, also, it is possible to reduce the exterior space of the vacuum container and make a compact vacuum switch by connecting each grounding switch of the interior of the vacuum container inside the vacuum container and providing a single grounding terminal through which the external of the vacuum container is connected.

According to the present invention, it is possible to reduce a space necessary for the external or exterior of the vacuum container and provide a compact vacuum switchgear by connecting the grounding switch inside the vacuum container and constructing so as to perform the connection to the external of the vacuum container by a single grounding terminal.

What is claimed is:

1. A vacuum switch comprising:

a vacuum container;

a grounding switch and a plurality of load switches each disposed in said vacuum container; and an external connection conductor disposed in said vacuum container and arranged to be connected electrically inside and outside said vacuum container, wherein said grounding switch and said external connection conductor are electrically connected to each other inside said vacuum container, and said plurality of load switches, each of which is at least one of a circuit breaker portion and a disconnecting switch portion, are electrically connected to each other to provide connection portions inside said vacuum container.

2. A vacuum switch according to claim 1, further comprising an insulator insulating from said vacuum container, wherein said insulator is made of ceramics.

3. A vacuum switch according to claim 2, characterized in that said insulator is made of alumina or zirconia ceramics.

4. A vacuum switch according to claim 1, wherein said connection portions are connected to each other by a flexible conductor.

5. A vacuum switch according to claim 4, characterized in that said flexible conductor is made of compound material in which non-oxygen copper plates and stainless steel plates, each being thinner than said non-oxygen copper plates and having an oxidized layer on a surface thereof, are laminated alternately.

6. A vacuum switch according to claim 4, further comprising a plurality of said grounding switch arranged on a straight line on a plane perpendicular to a make and break operation direction thereof.

7. A vacuum switch according to claim 4, characterized in that said flexible conductor is formed in a convex shape which is made convex in a reverse direction to a main circuit current passage portion so that a substantial distance between said flexible conductor and said main circuit current passage portion can be taken.

8. A vacuum switch according to claim 4, characterized in that said flexible conductor and each load switch are joined by vacuum brazing.

9. A vacuum switch according to claim 4, characterized in that said flexible conductor and said load switches are joined by melting plating provided connecting portions by heating said plating in a vacuum.

10. A vacuum switch according to claim 9, characterized in that said plating is silver-plating.

* * * * *